US007789071B2

(12) United States Patent
Akita et al.

(10) Patent No.: US 7,789,071 B2
(45) Date of Patent: Sep. 7, 2010

(54) FUEL SUPPLY SYSTEM FOR AN INTERNAL COMBUSTION ENGINE

(75) Inventors: Tatsuhiko Akita, Okazaki (JP); Mitsuto Sakai, Toyota (JP); Naoki Kurata, Nishikamo-gun (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 73 days.

(21) Appl. No.: 12/225,120

(22) PCT Filed: Apr. 11, 2007

(86) PCT No.: PCT/IB2007/000933

§ 371 (c)(1),
(2), (4) Date: Sep. 15, 2008

(87) PCT Pub. No.: WO2007/116301

PCT Pub. Date: Oct. 18, 2007

(65) Prior Publication Data

US 2009/0235901 A1 Sep. 24, 2009

(30) Foreign Application Priority Data

Apr. 12, 2006 (JP) ..... 2006-109830

(51) Int. Cl.
*F02M 63/00* (2006.01)
*F02M 63/02* (2006.01)

(52) U.S. Cl. ..... 123/447; 123/456

(58) Field of Classification Search ..... 123/431, 123/456, 447, 299, 300, 446, 457, 463, 469, 123/514, 304; 138/26, 30, 31; 137/510

See application file for complete search history.

(56) References Cited

U.S. PATENT DOCUMENTS

| | | | | |
|---|---|---|---|---|
| 4,205,637 | A * | 6/1980 | Ito et al. | 123/447 |
| 4,790,343 | A * | 12/1988 | Mochizuki | 137/80 |
| 5,076,320 | A * | 12/1991 | Robinson | 137/454.2 |
| 5,313,920 | A * | 5/1994 | Matsushita | 123/295 |
| 5,579,739 | A | 12/1996 | Tuckey et al. | |
| 5,911,208 | A | 6/1999 | Furusawa et al. | |
| 5,924,405 | A * | 7/1999 | Hashimoto | 123/431 |
| 6,155,235 | A * | 12/2000 | Kilgore | 123/467 |
| 6,422,265 | B1 * | 7/2002 | Beyer et al. | 137/510 |
| 6,484,756 | B1 * | 11/2002 | Weber | 138/30 |
| 6,688,322 | B2 * | 2/2004 | Wynn et al. | 137/15.19 |
| 6,901,964 | B2 * | 6/2005 | Kippe et al. | 138/30 |
| 7,073,486 | B2 * | 7/2006 | Nomura et al. | 123/446 |

(Continued)

FOREIGN PATENT DOCUMENTS

DE 195 28 737 A1 11/1996

(Continued)

*Primary Examiner*—Mahmoud Gimie
(74) *Attorney, Agent, or Firm*—Oliff & Berridge, PLC

(57) ABSTRACT

A pulsation damper is provided between and in series with a low pressure fuel system pipe and a high pressure pump of a fuel supply system. During startup of an engine, low pressure fuel supplied via the low pressure fuel system pipe is injected from an intake passage fuel injector. When the fuel pressure is equal to or less than a fuel pressure at which good startability can be maintained, the pulsation damper closes off communication between the high pressure fuel system pipe and the low pressure fuel system pipe using the spring force of a spring.

6 Claims, 6 Drawing Sheets

U.S. PATENT DOCUMENTS

| | | | | |
|---|---|---|---|---|
| 7,093,583 | B2 * | 8/2006 | Inoue et al. | 123/446 |
| 7,107,968 | B2 * | 9/2006 | Nomura | 123/456 |
| 2005/0066939 | A1 * | 3/2005 | Shimada et al. | 123/431 |
| 2006/0207547 | A1 * | 9/2006 | Saito | 123/260 |
| 2006/0207565 | A1 | 9/2006 | Nishimura | |
| 2006/0272618 | A1 | 12/2006 | Iwahashi | |
| 2007/0000478 | A1 | 1/2007 | Sadakane et al. | |

FOREIGN PATENT DOCUMENTS

| | | | |
|---|---|---|---|
| EP | 0 911 512 | A2 | 4/1999 |
| EP | 1 520 981 | A2 | 4/2005 |
| EP | 1 531 261 | A1 | 5/2005 |
| JP | A-7-103050 | | 4/1995 |
| JP | A-8-303313 | | 11/1996 |
| JP | A-2001-336439 | | 12/2001 |
| JP | A-2004-27950 | | 1/2004 |
| JP | A-2005-139923 | | 6/2005 |
| JP | A-2005-146882 | | 6/2005 |

* cited by examiner

FUEL SUPPLY SYSTEM FOR AN INTERNAL COMBUSTION ENGINE

BACKGROUND OF THE INVENTION

1. Field of the Invention

The invention relates to a fuel supply system for an internal combustion engine provided with a fuel injection mechanism that injects fuel at high pressure into a cylinder (i.e.; a fuel injector for in-cylinder injection, hereinafter referred to as "in-cylinder fuel injector") and a fuel injection mechanism that injects fuel into an intake passage or an intake port (i.e., a fuel injector for intake passage injection, hereinafter referred to as "intake passage fuel injector"). More particularly, the invention relates to a fuel supply system that can improve startability of an internal combustion engine.

2. Description of the Related Art

A gasoline engine is known which is provided with a fast fuel injection valve for injecting fuel into a combustion chamber of the engine (i.e., an in-cylinder fuel injector) and a second fuel injection valve for injecting fuel into an intake passage (i.e., an intake passage fuel injector), and divides the injected fuel between the in-cylinder fuel injector and the intake passage fuel injector according to the engine speed and engine load. Also, a direct injection gasoline engine is also known which is provided with only a fuel injection valve for injecting fuel into the combustion chamber of the engine (i.e., an in-cylinder fuel injector). In a high pressure fuel system that includes an in-cylinder fuel injector, fuel of which the pressure has been increased by a high pressure fuel pump is supplied to the in-cylinder fuel injector via a delivery pipe. The in-cylinder fuel injector then injects the high pressure fuel into the combustion chamber of each cylinder of the internal combustion engine.

In addition, a diesel engine is also known which has a common rail type fuel injection system. In this common rail type fuel injection system, fuel which has been increased in pressure by a high pressure fuel pump is stored in a common rail. The high pressure fuel is then injected into the combustion chamber of each cylinder of the diesel engine from the common rail by opening and closing an electromagnetic valve.

In order to increase the pressure of (i.e., pressurize) the fuel in this kind of internal combustion engine, a high pressure fuel pump is provided which is driven by a cam provided on a driveshaft that is connected to a crankshaft of the internal combustion engine.

Japanese Patent Application Publication No. JP-A-2005-139923 describes a high pressure fuel supply system for an internal combustion engine that can reduce vibrational noise when only a small amount of fuel is required by the internal combustion engine, such as during idling, while being able to deliver the necessary amount of fuel over the entire operating range of the internal combustion engine. This high pressure fuel supply system for an internal combustion engine has a two single plunger type high pressure fuel pumps each of which have a spill valve that spills fuel drawn into a pressurizing chamber that is divided by a cylinder and a plunger that moves back and forth in the cylinder, from that pressurizing chamber. When fuel is pressurized and delivered from the pressurizing chamber to the high pressure fuel system, the amount of fuel delivered is adjusted by controlling the spill valve open and closed. One of these high pressure fuel pumps is a first high pressure fuel pump in which the lift amount of the plunger is small and the other high pressure fuel pump is a second high pressure fuel pump in which the lift amount of the plunger is large. In addition to these two high pressure fuel pumps, the high pressure fuel supply system for an internal combustion engine also includes control means. The control means controls the spill valve of each high pressure fuel pump according to the amount of fuel required by the internal combustion engine, such that fuel is pressurized and delivered using only the first high pressure fuel pump when the amount of required fuel is small, and fuel is pressurized and delivered using at least the second high pressure fuel pump when the amount of required fuel is large.

According to this high pressure fuel supply system for an internal combustion engine, of the two high pressure fuel pumps, the first high pressure fuel pump has a plunger with a small lift amount so the rate of pressure increase is small and a large amount of water hammer is also self-suppressed. That is, with the high pressure fuel supply system, the vibrational noise produced when the required fuel quantity is small can be preferably reduced by controlling the spill valve of each of the high pressure fuel pumps so that only the first high pressure fuel pump is used when the amount of fuel required for the internal combustion engine is small such as during idling. On the other hand, the second high pressure fuel pump has a plunger with a large lift amount so pressurizing and delivering fuel using at least this second high pressure fuel pump also makes it possible to deliver the required fuel quantity when the amount of fuel required by the internal combustion engine increases to the point where it can no longer be delivered by the first high pressure fuel pump alone. That is, providing two high pressure fuel pumps having plungers with different lift amounts in this way enables the required amount of fuel to be delivered throughout the entire operating range of the internal combustion engine, while reducing vibrational noise when the amount of required fuel is small.

In Japanese Patent Application Publication No. JP-A-2005-139923, the high pressure fuel supply system for a V-type 8 cylinder internal combustion engine having an in-cylinder fuel injector in each cylinder is provided with a high pressure fuel pump for each bank. Tip ends that branch off from a low pressure fuel passage which is connected to the fuel tank are connected to galleries of these high pressure fuel pumps. For each bank, a pulsation damper is provided midway between the branch portion of the low pressure fuel passage and the portion that connects with the gallery. This pulsation damper suppresses the pulsation in the fuel pressure in the low pressure fuel passage when the high pressure fuel pump is operating. At engine startup in this kind of a direct injection engine having only an in-cylinder fuel injector, fuel is unable to be delivered by the high pressure fuel pump until the engine turns over. Therefore, low pressure fuel is delivered by a feed pump to the fuel injection for in-cylinder injection. Therefore, the pulsation damper is designed to provide communication between the high pressure pipe system and the low pressure pipe system. For example, FIG. 6 is a sectional view of such a pulsation damper 221, FIG. 7 is a sectional view taken along line VII-VII of FIG. 6, and FIG. 8 is a sectional view taken along line VIII-VIII of FIG. 7. As shown in FIGS. 6 to 8, grooves 223A, 223B, 223C, and 223D are provided in an end face (i.e., the upper surface in FIG. 8) that abuts against a contacting member 226A of the pulsation damper 221. Therefore, when the feed pressure is low, the spring 226D presses the contacting member 226A against the upper surface of the member that forms the inlet 222 and the outlet 224. In this way, the structure is such that even if pressure is applied by the spring 226D, the grooves 223A, 223B, 223C, and 223D enable fuel delivered from the inlet 222 (i.e., the feed pump side) to flow into the outlet 224 (i.e., the high pressure fuel pump side) as shown by the dotted line in FIG. 8.

On the other hand, as described above, an engine is known which includes, for each cylinder, an in-cylinder fuel injector that injects fuel into a combustion chamber of the engine and an intake passage fuel injector that injects fuel into an intake passage. In this engine, fuel is injected divided between the in-cylinder fuel injector and the intake passage fuel injector according to the engine speed and the load on the internal combustion engine. This engine is also provided with the pulsation damper shown in FIGS. 6 to 8.

However, in this kind of engine, the following problems occur when starting the engine by injecting fuel with an intake passage fuel injector. When fuel is delivered by a feed pump at engine startup, the volume of pipe that needs to be charged with fuel becomes significantly larger. That is, when the engine is started with fuel injected from the intake passage fuel injector, despite the fact that fuel can be delivered to the intake passage fuel injector with the feed pump by simply charging only the low pressure pipe with fuel, the pulsation damper is structured such that the high pressure pipe system and the low pressure pipe system are communicated or open to one another. Therefore, fuel is unable to be delivered to the intake passage fuel injector by the feed pump unless both the low pressure pipe and the high pressure pipe are charged with fuel. As a result, it takes time for the feed pressure to rise, thereby adversely affecting startability (i.e., increasing the start time).

SUMMARY OF THE INVENTION

This invention thus provides a fuel supply system for an internal combustion engine, which is capable of improving startability of an internal combustion engine that includes a fuel injection mechanism for injecting fuel at high pressure into a cylinder (i.e., in-cylinder fuel injector) and a fuel injecting mechanism for injecting fuel into an intake passage or an intake port (i.e., an intake passage fuel injector).

A first aspect of the invention relates to a fuel supply system for an internal combustion engine which includes a low pressure fuel supply passage that supplies fuel that was pressurized by a low pressure pump to a low pressure fuel injection mechanism which injects fuel into an intake passage; a branch passage that branches off from the low pressure fuel supply passage and supplies fuel to a high pressure pump that is driven by the internal combustion engine; a high pressure fuel supply passage that supplies fuel that was pressurized by the high pressure pump to a high pressure fuel injection mechanism which injects fuel into a cylinder; and a pulsation reducing mechanism provided on the intake side of the high pressure pump. The pulsation reducing mechanism closes off communication between the low pressure fuel supply passage and the high pressure fuel supply passage when a pressure of fuel in the low pressure fuel supply passage is lower than a predetermined value.

According to this first aspect, the high pressure pump which is driven by the internal combustion engine does not operate during startup of the internal combustion engine. In this case, the internal combustion engine is started by injecting fuel that has been pressurized by the low pressure pump from the low pressure fuel injection mechanism via the low pressure fuel supply passage. In this case, during startup of the internal combustion engine when the pressure of fuel in the low pressure fuel supply passage is low, the pulsation reducing mechanism closes off communication between the low pressure fuel supply passage and the high pressure fuel supply passage. Therefore, fuel can be delivered to the low pressure fuel injection mechanism simply by charging the low pressure fuel supply passage with fuel using the low pressure pump. Accordingly, there is no need to charge the high pressure fuel supply passage with fuel using the low pressure pump so the low pressure fuel supply passage and the branch passage that provides communication between the low pressure fuel supply passage and the high pressure pump can be charged with fuel quickly, and fuel can be quickly injected from the low pressure fuel injection mechanism. As a result, startability of an internal combustion engine provided with a fuel injection mechanism that injects fuel at high pressure into the cylinder and a fuel injection mechanism that injects fuel into the intake passage or intake port can be improved.

In addition to the structure of the first aspect, the pulsation reducing mechanism may be a pulsation damper and this pulsation damper may close off communication between the low pressure fuel supply passage and the high pressure fuel supply passage when the pressure of the fuel is less than the spring force of a spring of the pulsation damper.

According to the structure of this pulsation damper, the spring force of the spring of the pulsation damper against the pressure of the fuel closes off communication between the low pressure fuel supply passage and the high pressure fuel supply passage when the pressure of the fuel is low such as during startup of the internal combustion engine.

In the foregoing structure, and a branch passage may branch off from the low pressure fuel supply passage, at a portion upstream of the pulsation damper.

According to this kind of pipe structure, in a V-type internal combustion engine, for example, a plurality of cylinders are arranged in each bank. Accordingly, a high pressure fuel injection mechanism and a low pressure fuel injection mechanism are provided for each cylinder and there is a tendency for the length of the high pressure fuel supply passage that supplies fuel to the high pressure fuel injection mechanism to be long. Therefore, in this kind of engine, unless communication is closed off between the high pressure fuel supply passage and the low pressure fuel supply passage during startup of the internal combustion engine, it will take more time to charge the pipe volume with fuel using the low pressure pump than it would with an internal combustion engine of another configuration because the pipe volume is increased due to the longer high pressure pipe supply passage. The pulsation damper according to the foregoing aspect enables communication between the high pressure fuel supply passage and the low pressure fuel supply passage to be closed off by the spring force of the spring of the pulsation damper against the pressure of fuel when the pressure of the fuel in the low pressure fuel passage is low during startup of the internal combustion engine. As a result, an even greater operational effect can be displayed in this kind of V-type internal combustion engine, for example.

In the foregoing structure, a spring constant of the pulsation damper may be set based on engine startability according to the low pressure fuel injection mechanism.

According to this structure, the spring constant of the pulsation damper is set to keep the high pressure fuel supply passage closed off from the low pressure fuel supply passage, even if the fuel pressure is one that enables the internal combustion engine to start well by fuel being injected from the low pressure fuel injection mechanism. Therefore, fuel can be injected well from the low pressure fuel injection mechanism while the high pressure fuel supply passage is kept closed off from the low pressure fuel supply passage so the internal combustion engine can be started quickly.

Furthermore, the pulsation damper may also be arranged between and in series with the low pressure fuel supply passage and a pressurizing chamber of the high pressure pump.

According to this structure, the pulsation damper can close off communication between the high pressure fuel supply passage and the low pressure fuel supply passage.

BRIEF DESCRIPTION OF THE DRAWINGS

The foregoing and further objects, features and advantages of the invention will become apparent from the following description of preferred embodiments with reference to the accompanying drawings, wherein like numerals are used to represent like elements and wherein.

DETAILED DESCRIPTION OF THE PREFERRED EMBODIMENTS

Figure 1:
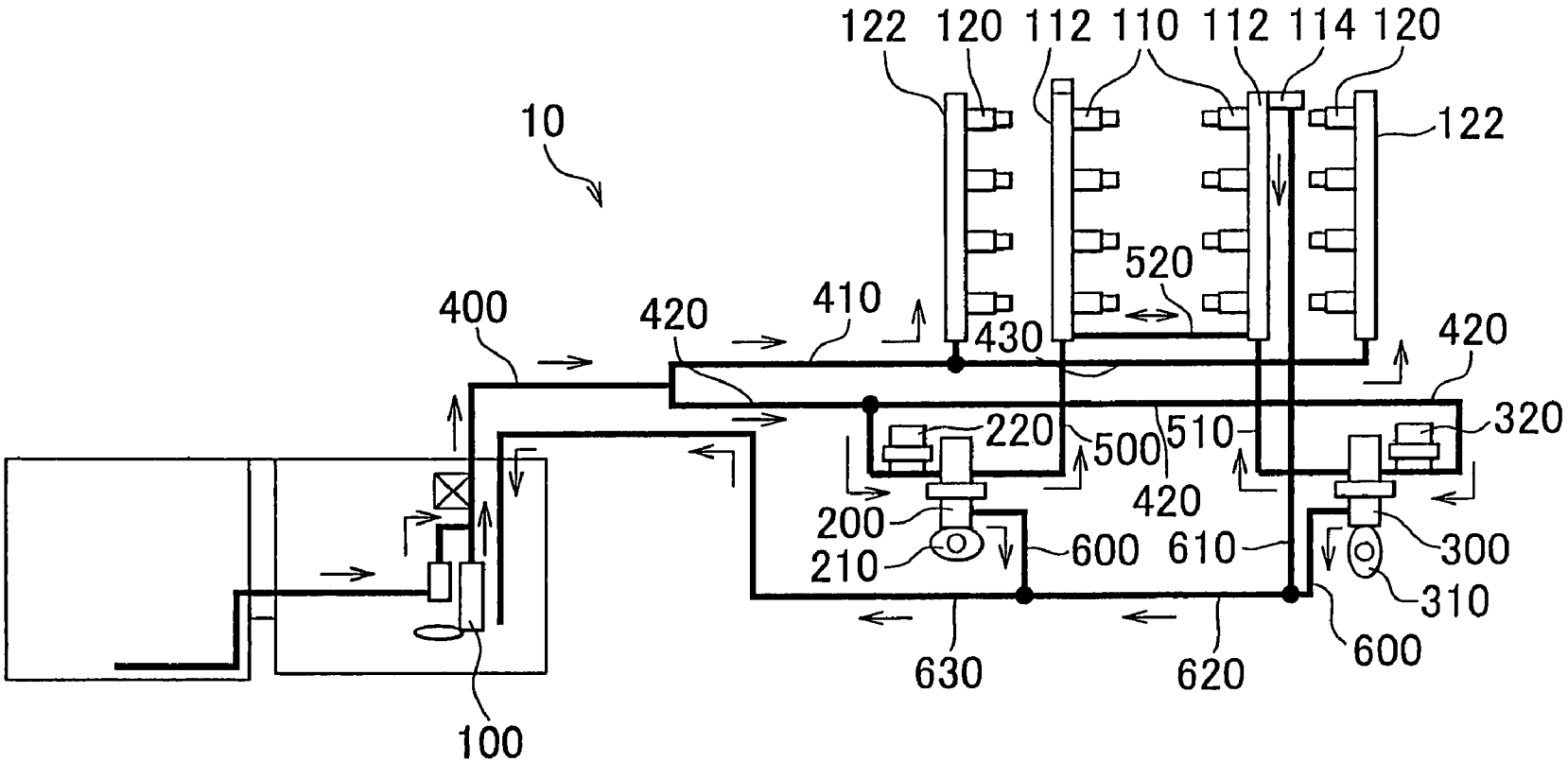
FIG. 1 is an overall schematic diagram of a fuel supply system according to one example embodiment of the invention.

Hereinafter, example embodiments of the invention will be described in detail with reference to the accompanying drawings. In the following description, like parts with be denoted by like reference numerals. Like parts will also be referred to by the same nomenclature and will have the same function. Therefore, detailed descriptions of those parts will not be repeated.

FIG. 1 shows a fuel supply system 10 which serves as a fuel supply system according to one example embodiment of the invention. The engine is a V-type 8 cylinder gasoline engine which has, in each cylinder, an in-cylinder fuel injector 110 for injecting fuel in each cylinder and an intake passage fuel injector 120 for injecting fuel into the intake passage of each cylinder. Incidentally, the invention is not limited to being applied to this kind of engine. That is, the invention may also be applied to a gasoline engine having another configuration or to a common rail type diesel engine. Further, the number of high pressure fuel pumps is not limited to two as long as there is at least one.

As shown in FIG. 1, this fuel supply system 10 includes a feed pump 100 that is provided in a fuel tank and supplies fuel at a low discharge pressure (of around 400 kPa which is the pressure regulator pressure); a first high pressure fuel pump 200 that is driven by a first cam 210; a second high pressure fuel pump 300 that is driven by a second cam 310 at a different discharge phase than the first cam 210; a high pressure delivery pipe 112 provided for both the left and right banks to supply high pressure fuel to in-cylinder fuel injectors 110; four in-cylinder injectors 110 for both the left and right banks, the in-cylinder injectors 110 being provided in the high pressure delivery pipe 112; a low pressure delivery pipe 122 provided in both the left and right banks for supplying fuel to intake passage fuel injectors 120; and four intake passage fuel injectors 120 for both the left and right banks, the intake passage fuel injectors 120 being provided in the low pressure delivery pipe 122.

An outlet of the feed pump 100 in the fuel tank is connected to a low pressure supply pipe 400 which branches off into a first low pressure delivery communicating pipe 410 and a pump supply pipe 420. The first low pressure delivery communicating pipe 410 is communicated with the low pressure delivery pipe 122 of one of the two banks of the V-type engine. Downstream of the branch point, the first low pressure delivery communicating pipe 410 is communicated with a second low pressure delivery communicating pipe 430 which is connected to the low pressure delivery pipe 122 of the other bank.

The pump supply pipe 420 is connected to the inlets of both the first high pressure fuel pump 200 and the second high pressure fuel pump 300. A first pulsation damper 220 is provided right before the inlet of the first high pressure fuel pump 200 and a second pulsation damper 320 is provided right before the inlet of the second high pressure fuel pump 300 in order to reduce fuel pulsation.

An outlet of the first high pressure fuel pump 200 is connected to a first high pressure delivery communicating pipe 500 which is connected to the high pressure delivery pipe 112 of one of the two banks of the V-type engine. An outlet of the second high pressure fuel pump 300 is connected to a second high pressure delivery communicating pipe 510 which is connected to the high pressure delivery pipe 112 of the other bank of the V-type engine. The high pressure delivery pipe 112 of one bank of the V-type engine and the high pressure delivery pipe 112 of the other bank of the V-type engine are connected together by a high pressure communicating pipe 520.

A return port of the high pressure fuel pump 300 is connected to a high pressure fuel pump return pipe 600 which is connected to a return pipe 620. This return pipe 620 is connected to a return pipe 630 which in turn leads to the fuel tank. Similarly, a return port of the high pressure fuel pump 200 is connected to another high pressure fuel pump return pipe 600 which is connected to the return pipe 630. Also, a relief valve 114 provided in one of the high pressure delivery pipes 112 is connected to the return pipe 620 via a high pressure delivery return pipe 610.

Figure 2:
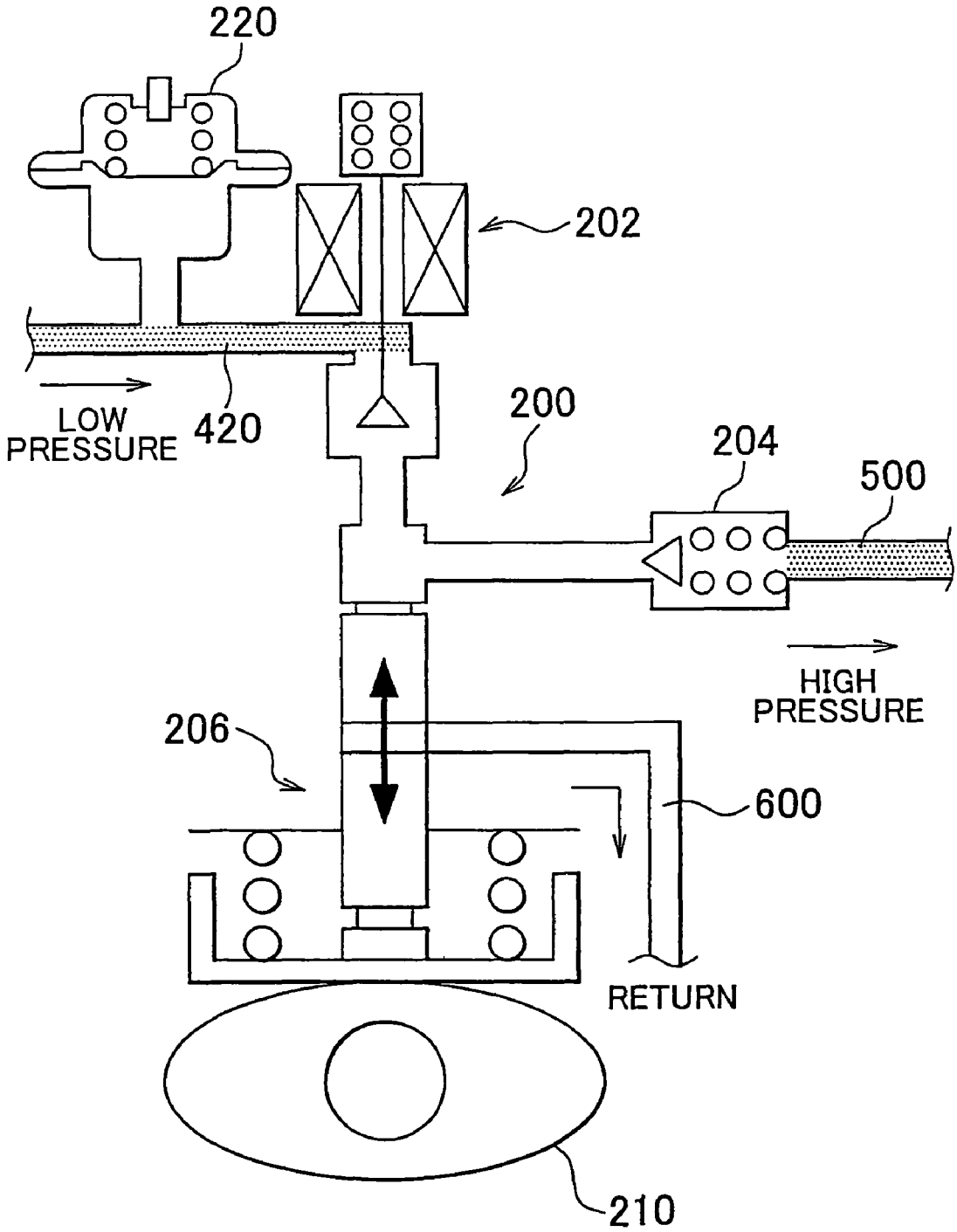
FIG. 2 is an enlarged view of a portion of the fuel supply system shown in FIG. 1.

FIG. 2 is an enlarged view of an area near the first high pressure fuel pump 200. The second high pressure fuel pump 300 is similar to the first high pressure fuel pump 200 but suppresses pulsation by having a different cam phase so that the phase of the discharge timing is offset with respect to the phase of discharge timing of the first high pressure fuel pump 200. Also, the characteristics of the first high pressure fuel pump 200 and the second high pressure fuel pump 300 may be the same or different. In the following description, the discharge performance of the first high pressure fuel pump 200 and the discharge performance of the second high pressure fuel pump 300 are the same according to the specifications but each has individual differences so the control characteristics differ.

The high pressure fuel pump 200 includes, as its main constituent parts, a pump plunger 206 which is driven up and down by the cam 210, an electromagnetic spill valve 202, and a check valve 204 with a leak function. When the cam 210 rotates such that the pump plunger 206 moves downwards and the electromagnetic spill valve 202 opens, fuel is introduced (drawn in). When the cam 206 continues to rotate such that the pump plunger 206 moves upwards, the electromagnetic spill valve 202 closes, thus stopping the inflow of fuel. The amount of fuel discharged from the high pressure fuel pump 200 is thereby controlled by changing the timing at which the electromagnetic spill valve 202 is closed. Closing the electromagnetic spill valve 202 earlier during the pressurizing stroke in which the pump plunger 206 is moving upward results in more fuel being discharged. Conversely, closing the electromagnetic spill valve 202 later during the pressurizing stroke in which the pump plunger 206 is moving upward results in less fuel being discharged. The drive duty of the electromagnetic spill valve 202 when the greatest amount of fuel is discharged is designated 100% and the drive duty of the electromagnetic spill valve 202 when the least amount of fuel is discharged is designated 0%. When the drive duty of the electromagnetic spill valve 202 is 0%, the electromagnetic spill valve 202 remains open. Although, as long as the first cam 210 is rotating (i.e., as long as the engine is operating), the pump plunger 206 will continue to slide up and down, fuel will not be pressurized because the electromagnetic spill valve 202 remains open.

Pressurized fuel pushes the check valve 204 with the leak function (which has a set pressure of approximately 60 kPa) open and is delivered to the high pressure delivery pipe 112 via the first high pressure delivery communicating pipe 500. At this time, the fuel pressure is feedback controlled by a fuel pressure sensor provided in the high pressure delivery pipe 112. Also, as described above, the high pressure delivery pipe 112 of one bank of the V-type engine and the high pressure delivery pipe 112 of other bank of the V-type engine are communicated by the high pressure communicating pipe 520.

The check valve 204 with the leak function is a normal check valve 204 having a tiny holes which is normally open. Therefore, if the pressure of fuel on the first high pressure fuel pump 200 (i.e., the pump plunger 206) side becomes lower than the pressure of fuel in the first high pressure delivery communicating pipe 500 (e.g., if the engine stops such that the cam 210 stops while the electromagnetic spill valve 202 is open), high pressure fuel in the first high pressure delivery communicating pipe 500 will return to the high pressure fuel pump 200 side through this tiny hole, thus lowering the pressure of the fuel inside the high pressure delivery communicating pipe 500 and the high pressure delivery pipes 112. Accordingly, for example, the fuel inside the high pressure delivery pipe 112 will no longer be at a high pressure when the engine is stopped so fuel leaking from the in-cylinder fuel injector 110 can be avoided.

The control amount used in the feedback control of the high pressure fuel pump 200 is calculated from an integral term that is updated according to the difference between the actual fuel pressure and a target value, and a proportional term which is increased or decreased to make that difference zero. As the control amount increases, so too does the amount of fuel discharged by the high pressure fuel pump 200, which increases the fuel pressure. Conversely, as the control amount decreases, so too does the amount of fuel discharged from the high pressure fuel pump 200, which decreases the fuel pressure.

If the actual fuel pressure is much higher than the target value, the integral term and the proportional term are both decreased to bring the actual fuel pressure down to the target value. However, because it takes time to reduce the fuel pressure, the integral term may end up becoming excessively low while the actual fuel pressure is being reduced to the target value. If the integral term becomes too low like this, the actual fuel pressure is unable to be kept at the target value once it has reached it, and continues to decrease even further, i.e., the actual fuel pressure ends up undershooting the target value.

More specifically, an engine ECU controls the quantity of fuel injected from the in-cylinder injection fuel injector 110 by controlling the in-cylinder fuel injector 110 based on a final fuel injection quantity. The quantity of fuel injected from this in-cylinder fuel injector 110 (i.e., the fuel injection quantity) is determined by the fuel pressure within the high pressure delivery pipe 112 and the fuel injection period so it is necessary to maintain the fuel pressure at an appropriate value in order to obtain an appropriate fuel injection quantity. Accordingly, the engine ECU maintains the fuel pressure P at an appropriate value by feedback controlling the amount of fuel discharged from the high pressure fuel pump 200 so that the fuel pressure required based on a detection signal from the fuel pressure sensor approaches a target fuel pressure P (0) set according to the operating state of the engine. Incidentally, the amount of fuel discharged from the high pressure fuel pump 200 is feedback controlled by adjusting the period for which the electromagnetic spill valve is closed (i.e., the timing at which the electromagnetic spill valve starts to close), as described above, based on a duty ratio DT which will be described next.

The duty ratio DT which is the control amount for controlling the amount of fuel discharged from the high pressure fuel pump 200 (i.e., the timing at which the electromagnetic spill valve 202 starts to close) will now be described. This duty ratio DT is a value that changes between values of 0 and 100%, and is related to the cam angle of the cam 210 which corresponds to the closed period of the electromagnetic spill valve 202. That is, if the cam angle corresponding to the maximum closed period of the electromagnetic spill valve 202 (i.e., the maximum cam angle) is designated "θ(0)", and the cam angle corresponding to a target value of the same closed period (i.e., the target cam angle) is designated "θ", then the duty ratio DT is a ratio that indicates the ratio of the target cam angle θ to the maximum cam angle θ (0). Accordingly, the duty ratio DT is a value that approaches 100% as the target closed period of the electromagnetic spill valve 202 (i.e., the timing at which the electromagnetic spill valve 202 starts to close) nears the maximum closed period, and a value that approaches 0% as the target closed period nears 0.

As the duty ratio DT approaches 100%, the timing at which the electromagnetic spill valve 202, which is adjusted based on the duty ratio DT, starts to close becomes earlier so the closed period of the electromagnetic spill valve 202 becomes longer. As a result, more fuel is discharged from the high pressure fuel pump 200 so the fuel pressure P rises. Also, as the duty ratio DT approaches 0%, the timing at which the electromagnetic spill valve 202 which is adjusted based on the duty ratio DT starts to close becomes later so the closed period of the electromagnetic spill valve 202 becomes shorter. As a result, less fuel is discharged from the high pressure fuel pump 200 so the fuel pressure P falls.

Figure 3:
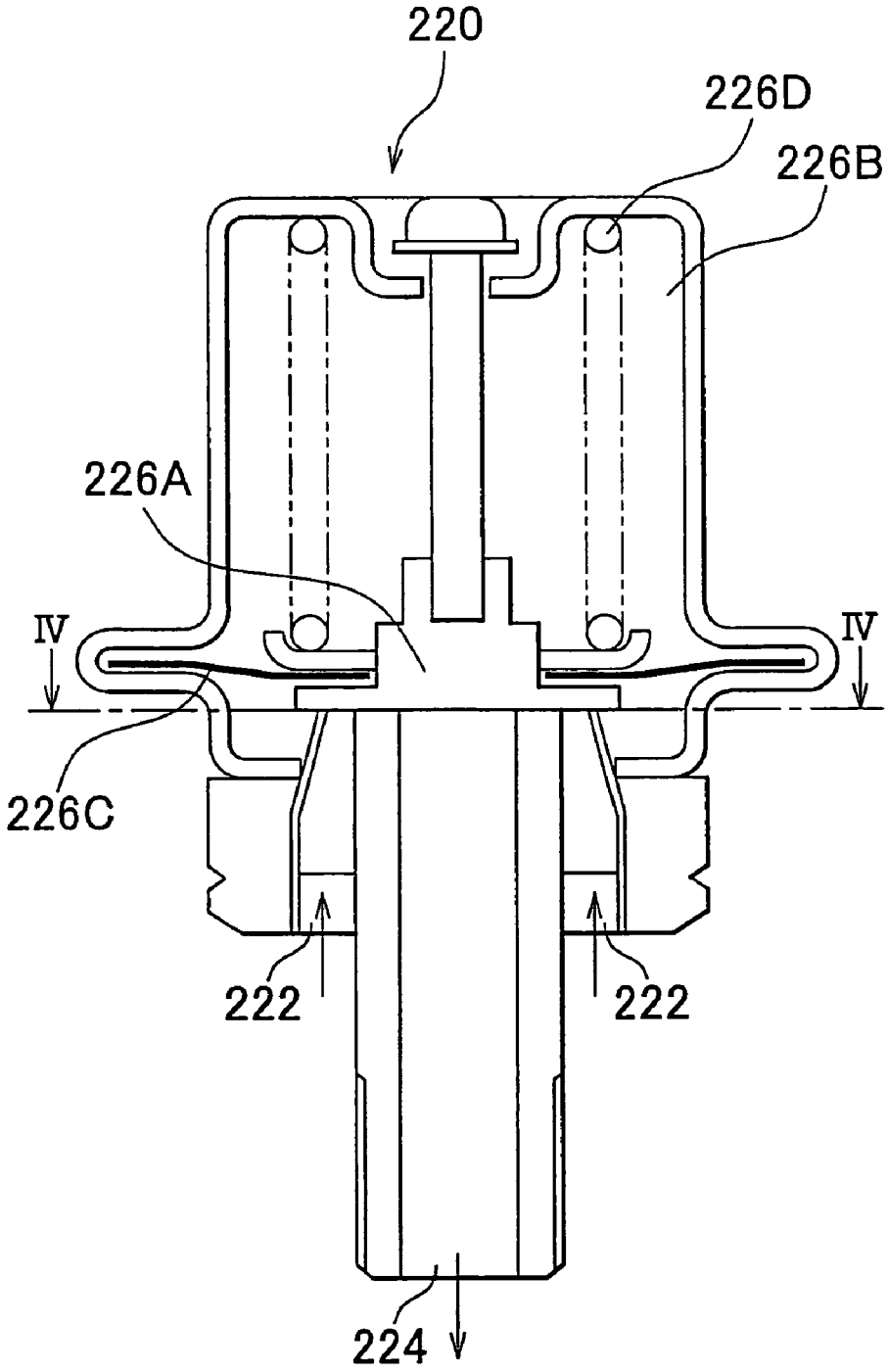
FIG. 3 is a sectional view of a pulsation damper shown in FIG. 1.

The pulsation damper shown in FIG. 1 will now be described with reference to FIG. 3. Incidentally, in the following description, only the pulsation damper 220 on the first high pressure fuel pump 200 side will be described. The pulsation damper 320 on the second high pressure fuel pump 300 side has the same structure as the pulsation damper 220 so a description of it will be omitted.

The pulsation damper 220 is a diaphragm type pulsation damper and includes a diaphragm 226C that separates a member that forms the inlet 222 and the outlet 224 from an air chamber 226B which is communicated with ambient air. This diaphragm 226C is supported by the spring 226D mounted in the air chamber 226B. Also, when the spring force of this spring 226D is greater than the pressure of the fuel introduced from the inlet 222, the contacting member 226A is pressed tightly against the member that forms the inlet 222 and the outlet 224.

The pulsation damper 220 is provided midway in the pump supply pipe 420 and upstream of the high pressure fuel pump 200. The upstream side of the pump supply pipe 420 is connected to the inlet 222 of the pulsation damper 220 and the downstream side of the pump supply pipe 420 is connected to the outlet 224 of the pulsation damper 220.

In this kind of structure, when the pump plunger 206 rises while the electromagnetic spill valve 202 is open in the high pressure fuel pump 200, pulsation generated in the pump supply pipe 420 by fuel being discharged and returned from the high pressure fuel pump 200 is transmitted to the pulsation damper 220. This pulsation can be reliably reduced by the diaphragm 226C of the pulsation damper 220 vibrating against the spring 226D.

Figure 4:
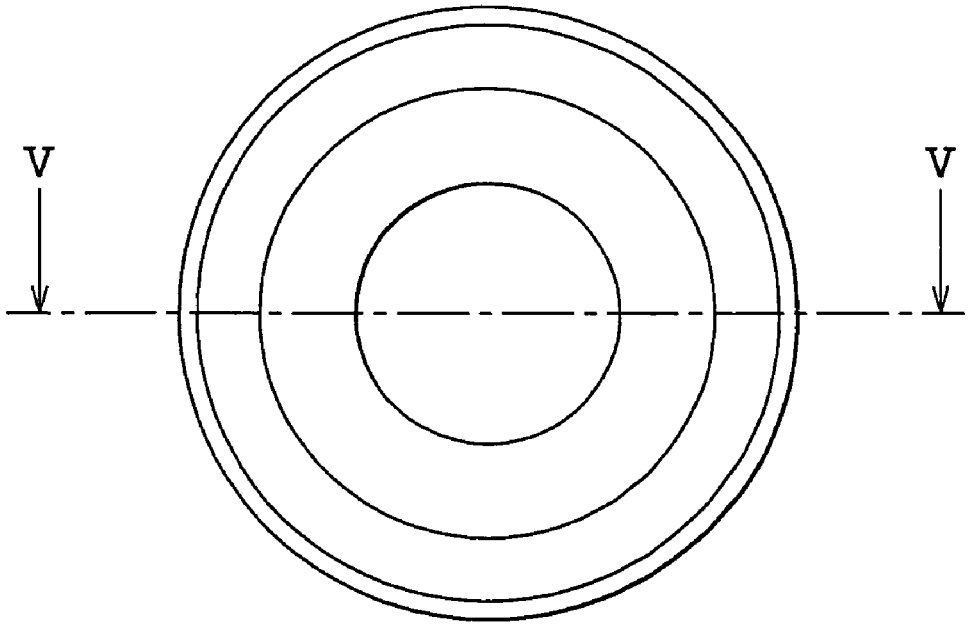
FIG. 4 is a sectional view taken along line IV-IV of FIG. 3.
Figure 5:
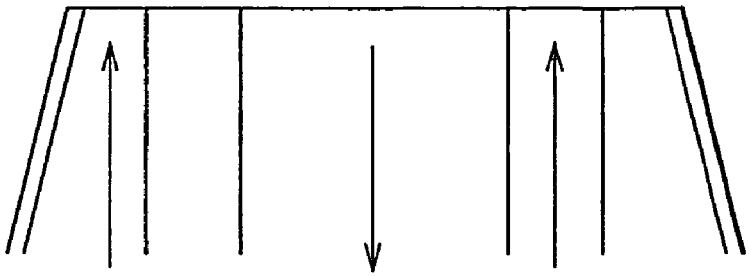
FIG. 5 is a sectional view taken along line V-V of FIG. 4.
Figure 6:
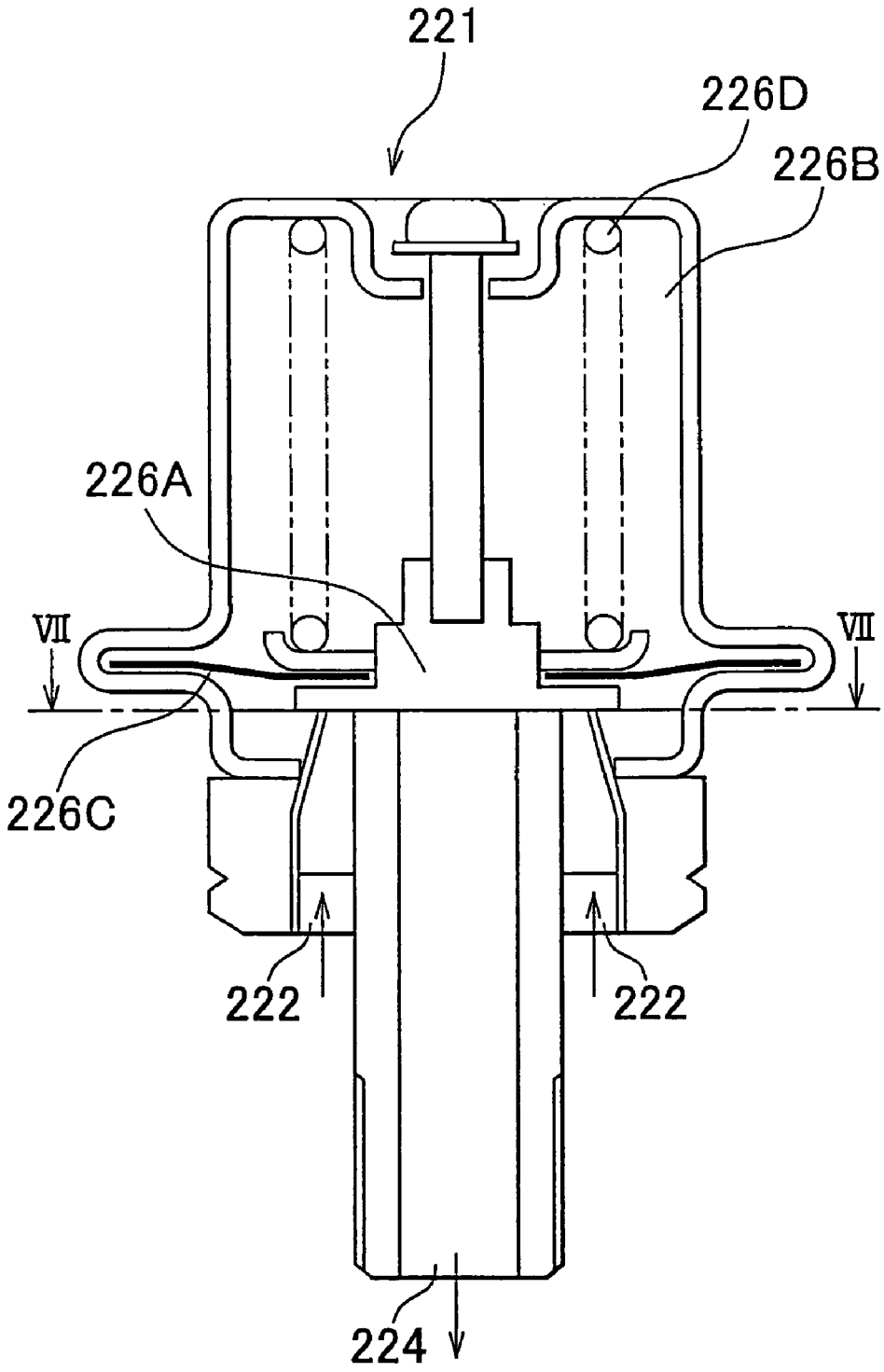
FIG. 6 is a sectional view of a related pulsation damper.
Figure 7:
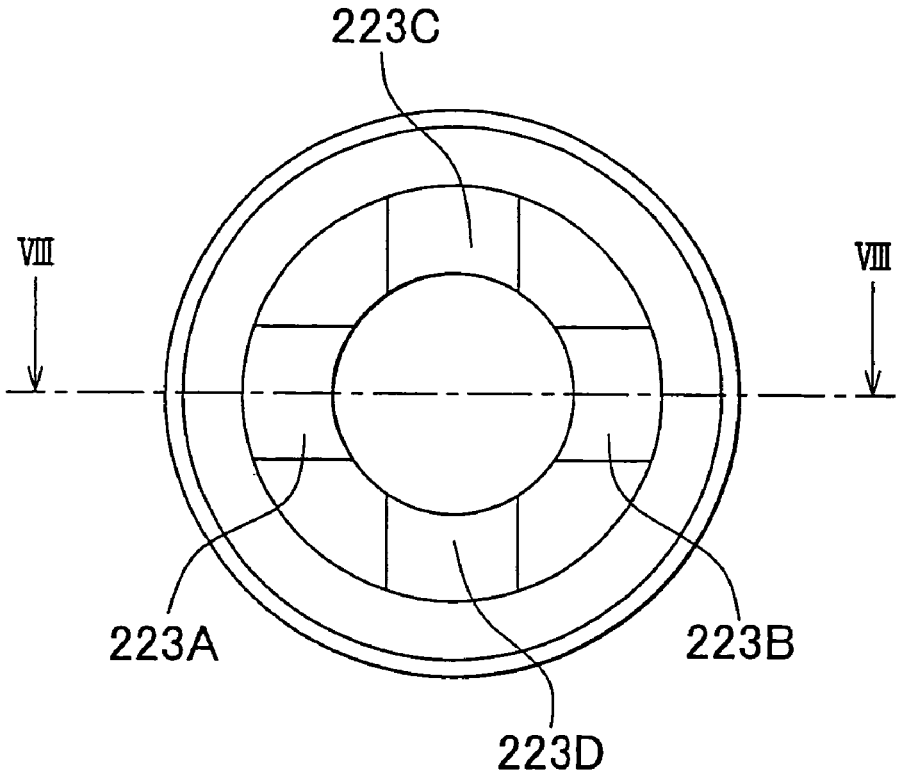
FIG. 7 is a sectional view taken along line VII-VII of FIG. 6.
Figure 8:
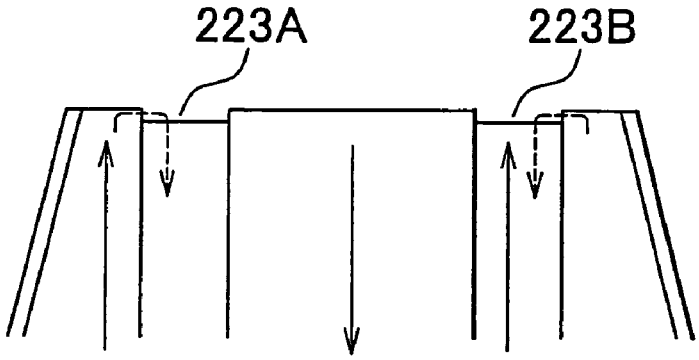
FIG. 8 is a sectional view taken along line VIII-VIII of FIG. 7.

The most characteristic part of the fuel supply system for an internal combustion engine according to the example embodiment of the invention is that there are no grooves like the grooves 223A, 223B, 223C, and 223D that are formed in the related pulsation damper 221 (see FIGS. 6 to 8). FIG. 3 is a sectional view of this kind of pulsation damper 220, FIG. 4 is a sectional view taken along line IV-IV of FIG. 3, and FIG. 5 is a sectional view taken along line V-V of FIG. 4. As shown in FIGS. 3 to 5, there are no grooves like the grooves 223A, 223B, 223C, and 223D of the pulsation damper 221 in the end face (i.e., the upper surface in FIG. 6) that the contacting member 226A of the pulsation damper 220 contacts. Instead, that end face has a smooth surface.

Therefore, when the feed pressure is low, the spring 226D urges the contacting member 226A into contact with the smooth upper surface of the member that forms the inlet 222 and the outlet 224. When the contacting member 226A is forced into contact with the smooth upper surface of that member by the spring 226D in this way, fuel that was delivered from the inlet 222 (i.e., from the feed pump 100 side) does not flow into the outlet 224 (i.e., to the high pressure fuel pump side) as shown by the dotted lines in FIG. 8 because the grooves 223A, 223B, 223C, and 223D are not provided. Therefore, the spring constant is set such that, with a feed pressure of 400 kPa, for example, the contacting member 226A is urged by the spring 226D to contact the smooth upper surface of the member that forms the inlet 222 and the outlet 224 until the feed pressure reaches approximately 200 kPa. Accordingly, the high pressure pipe system and the low pressure pipe system are kept closed off from one another by the pulsation damper 220 until the fuel pressure reaches 200 kPa. Once the fuel pressure is 200 kPa or greater, the pulsation damper 220 opens communication between the high pressure pipe system and the low pressure pipe system. That is, the internal combustion engine is started by injecting fuel which has been pressurized by the feed pump 100 from the intake passage fuel injector 120 via the first low pressure delivery communicating pipe 410 and the low pressure delivery pipe 122. Therefore, in order to start the internal combustion engine, the fuel pressure in the low pressure pipe system must reach a desired pressure (such as 200 kPa). However, if fuel flows into the high pressure pipe system while it is being pressurized by the feed pump 100, it will take longer for the fuel pressure in the low pressure pipe system to rise. Therefore, when the fuel pressure in the low pressure pipe system is less than the desired pressure, it is preferable to close off communication to the high pressure pipe system and smoothly increase the fuel pressure in the low pressure pipe system. That is, the spring constant may be set taking startability of the internal combustion engine into account.

Operation of the fuel supply system having the kind of structure described above will now be described. When starting the engine using the intake passage fuel injector 120 and the feed pressure is low, the pulsation damper 220 keeps the high pressure pipe system closed off from the low pressure pipe system. As a result, fuel can be delivered to the intake passage fuel injector 120 simply by charging only the low pressure pipe system with fuel using the feed pump 100.

The engine is quickly started by injecting fuel delivered to the intake passage fuel injector 120 and cranking with the starter motor.

On the other hand, as with the related pulsation damper 221 (see FIGS. 6 to 8), if the feed pressure is low and the pulsation damper 221 allows communication between the high pressure pipe system and the low pressure pipe system via grooves, fuel cannot be delivered to the intake passage fuel injector without fuel being charged in both the low pressure pipe system and the high pressure pipe system by the feed pump 100. Therefore, even if the engine is cranked with the starter motor, fuel is unable to be injected from the intake passage fuel injector 120 so the engine will not start. Moreover, only after the feed pump 100 has operated for an extended period of time and fuel is charged in the pipes of both the high pressure pipe system and the low pressure pipe system that remain communicated with one another by the grooves in the pulsation damper 221 is fuel delivered to the intake passage fuel injector 120 so that the engine can start.

As described above, according to the fuel supply system according to this example embodiment, a new pulsation damper is used which eliminates the grooves in the pulsation damper used in a conventional direct injection engine (which has only an in-cylinder fuel injector in each cylinder) (i.e., which eliminates the grooves for delivering fuel from the feed pump to the in-cylinder fuel injector by keeping communication open between the low pressure fuel system and the high pressure fuel system even when the feed pressure during engine startup is low). This new pulsation damper closes off the low pressure fuel system from the high pressure fuel system until a set fuel pressure is reached so the engine can start by injecting fuel using the intake passage fuel injector by simply charging only the low pressure fuel system with fuel. In particular, in a V-type engine, a high pressure fuel system pipe is provided for each bank of cylinders so the volume of the high pressure fuel system pipes increases. In such an engine, fuel can be delivered to the intake passage fuel injector using the feed pump by charging only the pipes of the low pressure fuel system with fuel so the engine can be started quickly.

The example embodiments disclosed herein are in all respects merely examples and should in no way be construed as limiting. The scope of the invention is indicated not by the foregoing description but by the scope of the claims for patent, and is intended to include all modifications that are within the scope and meanings equivalent to the scope of the claims for patent.

The invention claimed is:

1. A fuel supply system for an internal combustion engine, comprising:

a low pressure pump that is capable to pressurize fuel;

a low pressure fuel supply passage that is capable to supply fuel that was pressurized by the low pressure pump to a low pressure fuel injection mechanism which injects fuel into an intake passage;

a branch passage that branches off from the low pressure fuel supply passage and through which the fuel that was pressurized by the low pressure pump flows;

a high pressure pump which is capable to pressurize the fuel supplied via the branch passage, the high pressure pump being driven by the internal combustion engine;

a high pressure fuel supply passage that is capable to supply fuel that was pressurized by the high pressure pump to a high pressure fuel injection mechanism which injects fuel into a cylinder; and a pulsation reducing mechanism provided on an intake side of the high pressure pump, wherein, when the internal combustion engine is started by only injecting fuel from the low pressure supply passage into the intake passage, the pulsation reducing mechanism closes off communication between the low pressure fuel supply passage and the high pressure fuel supply passage until a pressure of fuel in the low pressure fuel supply passage reaches a predetermined pressure value required for starting the internal combustion engine.

2. The fuel supply system for an internal combustion engine according to claim 1, wherein the pulsation reducing mechanism is a pulsation damper; the pulsation damper opens communication between the low pressure fuel supply passage and the high pressure fuel supply passage when the pressure of the fuel in the low pressure fuel supply passage is equal to or greater than the spring force of a spring of the pulsation damper; and the pulsation damper closes off communication between the low pressure fuel supply passage and the high pressure fuel supply passage when the pressure of the fuel is less than the spring force of the spring of the pulsation damper.

3. The fuel supply system for an internal combustion engine according to claim 2, wherein the pulsation damper includes an inlet that opens to the branch passage, an outlet that opens to a pressurizing chamber of the high pressure pump, and a member that closes off the inlet and the outlet by being pressed against by the spring force of the spring.

4. The fuel supply system for an internal combustion engine according to claim 2, wherein the branch passage branches off from the low pressure fuel supply passage at a portion upstream of the pulsation damper.

5. The fuel supply system for an internal combustion engine according to claim 2, wherein the spring constant of the pulsation damper is set based on engine startability according to the low pressure fuel injection mechanism.

6. The fuel supply system for an internal combustion engine according to claim 2, wherein the pulsation damper is arranged between and in series with the low pressure fuel supply passage and a pressurizing chamber of the high pressure pump.

* * * * *